US007049903B2

(12) United States Patent
Herstein et al.

(10) Patent No.: US 7,049,903 B2
(45) **Date of Patent: *May 23, 2006**

(54) TRANSITION FROM A COAXIAL TRANSMISSION LINE TO A PRINTED CIRCUIT TRANSMISSION LINE

(75) Inventors: Dov Herstein, 25 Finland Street, Haifa 34989 (IL); Yonatan Biran, Timrat (IL)

(73) Assignees: Cyoptics (Israel) Ltd., Yokneam Illit (IL); Dov Herstein, Yokneam Illit (IL)

( * ) Notice: Subject to any disclaimer, the term of this patent is extended or adjusted under 35 U.S.C. 154(b) by 389 days.

This patent is subject to a terminal disclaimer.

(21) Appl. No.: 10/253,389

(22) Filed: Sep. 24, 2002

(65) Prior Publication Data

US 2003/0169125 A1 Sep. 11, 2003

Related U.S. Application Data

(63) Continuation-in-part of application No. 10/093,095, filed on Mar. 7, 2002.

(51) Int. Cl.
*H01P 1/04* (2006.01)

(52) U.S. Cl. ..... 333/33; 333/260; 439/63

(58) Field of Classification Search ..... 333/26, 333/33, 34, 245, 260; 439/63, 581
See application file for complete search history.

(56) References Cited

U.S. PATENT DOCUMENTS

| | | | | | |
|---|---|---|---|---|---|
| 3,201,721 | A | | 8/1965 | Rudolph | 333/33 |
| 3,539,966 | A | | 11/1970 | Logan | 339/17 |
| 3,662,318 | A | * | 5/1972 | Decuyper | 439/63 |
| 3,783,321 | A | * | 1/1974 | Patterson | 361/772 |
| 4,494,083 | A | | 1/1985 | Josefsson et al. | 333/33 |
| 4,567,449 | A | | 1/1986 | Bert et al. | 331/56 |
| 4,595,890 | A | | 6/1986 | Cloutier | 333/106 |
| 4,656,441 | A | * | 4/1987 | Takahashi et al. | 333/33 |
| 4,754,241 | A | | 6/1988 | Spinner | 333/111 |
| 4,810,981 | A | | 3/1989 | Herstein | 333/27 |
| 4,975,065 | A | * | 12/1990 | Rosenberg et al. | 439/63 |
| 5,142,255 | A | * | 8/1992 | Chang et al. | 333/204 |
| 5,165,109 | A | | 11/1992 | Han et al. | 343/700 |
| 5,231,349 | A | | 7/1993 | Majidi-Ahy et al. | 324/158 |
| 5,404,117 | A | * | 4/1995 | Walz | 333/34 |
| 5,475,394 | A | | 12/1995 | Kohls et al. | 343/700 |
| 5,516,303 | A | | 5/1996 | Yohn et al. | 439/248 |
| 5,532,659 | A | * | 7/1996 | Dodart | 333/260 |
| 5,943,020 | A | | 8/1999 | Liebendoerfer et al. | 343/702 |

FOREIGN PATENT DOCUMENTS

JP 61 174801 6/1986

OTHER PUBLICATIONS

Corning Gilbert, Inc. of Glendale Arizona, a Gilbert Puny Push on (GPPO), Catalog Serial Nos.: B010–L and B009–P, May 2001.

Patent Abstract of Japan vol. 10, No. 384, Dec. 23, 1986 & JP 61 174801.

Anrtisu, Precision RF & Microwave Components Catalog 2001 p. 11.

* cited by examiner

*Primary Examiner*—Robert Pascal
*Assistant Examiner*—Dean Takaoka
(74) *Attorney, Agent, or Firm*—Ladas & Parry LLP

(57) ABSTRACT

A transition piece for coupling a coaxial transmission line to a printed circuit (PC) transmission line. The transmission line terminates in a conductive pin projecting through a conductive coaxial ground plane. The transition piece consists of a conductive plate which is adapted to be fixed between the coaxial ground plane and a PC ground plane of the PC transmission line. The plate is in electrical contact with both the coaxial and PC ground planes while the conductive pin contacts a conductive strip of the PC transmission line. Furthermore, the plate has an opening which is shaped and aligned with the pin so that a transition-impedance of the transition piece is substantially equal to a line impedance of the coaxial and PC transmission lines.

39 Claims, 7 Drawing Sheets

TRANSITION FROM A COAXIAL TRANSMISSION LINE TO A PRINTED CIRCUIT TRANSMISSION LINE

RELATED APPLICATION

This application is a continuation-in-part to U.S. application Ser. No. 10/093,095 titled "Transition from a Coaxial Transmission Line to a Printed Circuit Transmission Line" filed Mar. 7, 2002, which is incorporated herein by reference.

FIELD OF THE INVENTION

The present invention relates generally to couplings, and specifically to couplings between electronic transmission lines operating at high frequencies.

BACKGROUND OF THE INVENTION

Electronic transmission lines which are able to operate at frequencies of the order of 50 GHz require careful design in order to ensure efficient operation, specifically to reduce unwanted energy reflections and/or absorptions. Moreover, interconnecting these lines without careful design of the interconnections may lead to further similar inefficiencies of operation. Types of lines which are used to propagate these frequencies include coaxial and printed circuit (PC) transmission lines.

In the specification and in the claims, a PC transmission line is assumed to be any transmission line formed on a printed circuit board which is able to propagate frequencies in a range from DC (0 Hz) to approximately 50 GHz. Typically, a PC transmission line comprises a "signal" strip separated and insulated from at least one ground strip and/or ground plane. PC transmission lines are well known in the electronics art, and may be termed, inter alia, microstrip, stripline, stripguide, coplanar waveguide (CPW), grounded coplanar waveguide (GCPW), and/or slot line(s).

Corning Gilbert Inc., of Glendale, Ariz., produce a Gilbert Puny Push On (GPPO) edge mount, catalog series number B010-L, and a GPPO right angle to printed circuit board coupling, catalog series number B009-P, both of which are designed to couple a PC transmission line to a coaxial transmission line. In both cases, the component is connected to the PC transmission line, and the combined component and transmission line may then be "pushed-on" to the coaxial transmission line so that the two lines are interconnected.

In many cases, a component having a coaxial transmission line output is adjusted to optimize performance of the component, and/or has measurements made on the component, before the component is ready for final use. Typically, a connector is attached to the output, enabling a standard coaxial connector to be coupled to the component's output. After the adjustments and/or measurements have been made, the connector is removed and the component is available for final use as a "drop-in" component.

U.S. Pat. No. 3,539,966, to Logan, whose disclosure is incorporated herein by reference, describes a PC transmission line to coaxial line connector which can be attached to a printed circuit board. A coaxial line adapter is soldered in place on the board, and an outer shell assembly is clamped over the adapter and is held in place by screws.

Couplings for connecting transmission lines operating at frequencies of 50 GHz and above need to pay particular attention to surface currents flowing on the grounds, in order to operate efficiently. In order to maintain a good ground regime, i.e., proper alignment of ground paths, differences between electrical properties (e.g., inductance and resistance differences) of incident and return currents must be minimized.

SUMMARY OF THE INVENTION

It is an object of some aspects of the present invention to provide a method and apparatus for coupling a coaxial output to a printed circuit transmission line.

In preferred embodiments of the present invention, a conductive plate acts as a transition between an output of a coaxial transmission line and a printed circuit (PC) transmission line, both lines having substantially the same impedance and being able to operate at frequencies from DC to approximately 50 GHz. The coaxial output comprises a pin and a conductive ground plane, which are typically part of a component conveying high frequency signals. There is a circular opening in the ground plane, and the pin penetrates the ground plane orthogonally via the opening, the pin being centered on the opening, thus forming a coaxial transmission line. Dimensions of the pin and the opening are implemented so as to generate a known impedance for the coaxial output, preferably substantially equal to 50 ohms.

The PC transmission line comprises a conductive linear "signal" strip, preferably having two conductive PC ground planes positioned with substantially equal spacing on either side of the strip, although other PC ground plane arrangements known in the art, such as use of a plane beneath the signal strip with/without plated vias, are possible. Dimensions of the signal strip, its spacing to the PC ground planes, and dielectric constants of insulating media comprised in the PC line, are implemented so that an impedance of the PC line is substantially equal to the impedance of the coaxial output.

The transition is preferably in the form of a generally rectangular plate. The plate preferably comprises two edge fingers between which is formed a semicircular arc, the arc center lying midway between the edge fingers. Alternatively, the two fingers are formed within the plate, rather than at an edge. The fingers of the transition are bent to form lugs substantially at right angles to the transition, for subsequent attachment to the printed circuit. After bending, a semicircular opening remains in the transition which has been foreshortened by the formation of the lugs. The transition is attached to the ground plane (of the component) so that the pin of the coaxial output is substantially coincident with the arc center, penetrating the semicircular opening.

Alternatively, the two lugs and the semicircular opening of the transition plate are formed by methods other than bending which are known in the art, such as by milling or chemical etching of a single piece of material.

In an alternative preferred embodiment of the present invention, the transition plate comprises a substantially circular hole, in place of the semicircular opening described above, the two lugs and a diameter of the hole lying in a plane at right angles to the transition.

Most preferably, the transition is attached by screws to the component, via openings in the transition which align with tapped holes in the ground plane of the component. Preferably, the screws comprise flathead screws, and the openings in the transition comprise countersunk holes with which the flathead screws mate, so that after attachment surfaces of heads of the screws and the transition have a common plane. Alternatively, the screws comprise heads other than flatheads, so that after attachment the heads protrude from the transition. Further alternatively, the transition is welded to the component by one of the welding methods known in the art, such as spot welding. The attached transition and component are herein termed a "drop-in" component.

The drop-in component is positioned with respect to the PC transmission line so that an edge of the line butts to the transition, the coaxial pin contacts the signal strip, and the lugs of the transition contact the ground planes of the PC transmission line. If flathead screws are used to form the drop-in component, the edge of the PC transmission line may be a substantially straight line. If other screws are used, the edge of the PC transmission line may need to be indented to accommodate protrusion of the screws. The pin and the signal strip are connected together, and the lugs and the ground planes are also connected/soldered together, by methods known in the art, such as welding, soldering, or use of conductive glue. The combination of the semicircular arc or circular hole of the transition with the pin of the coaxial output forms an air-filled transmission line. When forming the transition, a diameter of the semicircular arc or circular hole is set so that an impedance of the transition, i.e., of the air-filled transmission line, after the transition has been mated with the ground plane, is substantially equal to the impedances of the coaxial output and the PC transmission line.

The transition thus couples the coaxial output and the PC transmission line efficiently, since the transition is designed to provide substantially the same impedance as the output and the line. The transition provides a good mating surface to the ground plane of the coaxial output, enabling the PC transmission line to be easily mechanically coupled to the coaxial output. Also, since the transition is formed from a single conductive sheet, it is significantly easier to implement than transitions known in the art. Moreover, the conductive plate provides a proper ground regime, coupling the ground plane of the coaxial transmission line to the ground planes of the printed circuit, and providing a good ground transition at frequencies of the order of 50 GHz.

In some preferred embodiments of the present invention, a "stress-relief contact" is coupled to the coaxial pin before the PC transmission line and the drop-in component are connected. The stress-relief contact comprises a split cylinder and a tab, the split cylinder slidingly mating with the coaxial pin. The PC transmission line is coupled to the drop-in component so that the tab contacts the central strip, the tab is welded/soldered to the central strip and the lugs are welded/soldered to the ground planes, substantially as described above. The diameter of the semicircular arc or circular hole is most preferably adjusted to allow for the effective increased diameter of the coaxial pin due to the addition of the split cylinder, so as to maintain the impedance of the transition substantially equal to the impedances of the coaxial output and PC transmission line.

There is therefore provided, according to a preferred embodiment of the present invention, a transition piece for coupling a coaxial transmission line, which terminates in a conductive pin projecting through a conductive coaxial ground plane, to a printed circuit (PC) transmission line, the transition piece including:

a conductive plate, which is adapted to be fixed between the coaxial ground plane and a PC ground plane of the PC transmission line so that the plate is in electrical contact with both the coaxial and PC ground planes while the conductive pin contacts a conductive strip of the PC transmission line, the plate having an opening which is shaped and aligned with the pin so that a transition-impedance of the transition piece is substantially equal to a line impedance of the coaxial and PC transmission lines.

Preferably, the opening is formed in an edge of the conductive plate, and the conductive plate includes lugs, the lugs being adapted to be connected to the PC ground plane.

Preferably, the lugs are substantially orthogonal to a plane of the transition piece, and a printed circuit implementing the PC transmission line is substantially orthogonal to the coaxial ground plane.

Preferably, the lugs consist of two lugs which are disposed symmetrically about the opening.

Further preferably, the lugs are formed by bending fingers forming the opening of the conductive plate substantially orthogonal thereto.

Preferably, the transition piece includes a stress-relief contact formed of a hollow cylinder coupled to a connecting tab, a wall of the hollow cylinder being split parallel to an axis of the cylinder, the stress-relief contact being aligned so that the hollow cylinder slidingly mates with the conductive pin and the connecting tab contacts the conductive strip.

Alternatively, the opening is formed within the conductive plate, and the conductive plate includes lugs, the lugs being adapted to be connected to the PC ground plane.

Preferably, the lugs are substantially orthogonal to a plane of the transition piece, and a printed circuit implementing the PC transmission line is substantially orthogonal to the coaxial ground plane.

Preferably, the lugs consist of two lugs which are disposed symmetrically about the opening.

Preferably, the lugs are formed by bending fingers forming the opening of the conductive plate substantially orthogonal thereto.

Preferably, the coaxial ground plane is implemented so as to protrude in a region close to the conductive pin.

Alternatively or additionally, the conductive plate is implemented so as to protrude from a plane including the plate in a region close to the opening.

Preferably, the conductive plate includes one or more further openings through which respective one or more screws penetrate so as to mate the plate with the coaxial ground plane.

Further preferably, the one or more further openings include respective one or more truncated conical holes, and the screws include respective flathead screws which seat in the respective truncated conical holes.

Preferably, the respective flathead screws seat in the respective truncated conical holes to form a substantially flat surface with the conductive plate.

Further preferably, a printed circuit which implements the PC transmission line includes a non-indented straight edge which mates with the flat surface.

Preferably, the opening is formed as a generally rectangular indentation in an edge of the conductive plate, and as a semicircular arc having a diameter of the arc aligned with, and symmetrically disposed with respect to, a side of the indentation parallel to the edge.

Preferably, the opening includes a substantially circular hole within the conductive plate.

Preferably, the conductive plate includes a substantially flat surface which mates with a substantially straight edge of the PC transmission line, the surface and the PC ground plane being adapted to receive coupling material which electrically connects the surface and the PC ground plane, and which fixedly maintains the PC transmission line relative to the surface.

Preferably, the conductive plate includes at least one lug, the PC transmission line includes an upper and a lower side, the PC ground plane is formed on at least one of the upper and lower sides, the conductive strip is formed on the at least one of the upper and lower sides, the at least one lug is adapted to connect to the PC ground plane formed on the at least one of the upper and lower sides, and the conductive pin is adapted to connect to the conductive strip formed on the at least one of the upper and lower sides.

There is further provided, according to a preferred embodiment of the present invention, a method for coupling a coaxial transmission line, which terminates in a conductive pin projecting through a conductive coaxial ground plane, to a printed circuit (PC) transmission line, the method including:

providing a conductive plate;

removing material from the plate so as to form an opening in the plate; and connecting the plate between the coaxial ground plane and a PC ground plane of the PC transmission line so that the plate is in electrical contact with both the coaxial and PC ground planes while the conductive pin contacts a conductive strip of the PC transmission line and aligns with the opening so that a transition-impedance of the transition piece is substantially equal to a line impedance of the coaxial and PC transmission lines.

Preferably, the opening is formed in an edge of the conductive plate.

Preferably, removing the material includes forming an indentation in the edge, and wherein connecting the plate includes forming lugs therein and connecting the lugs to the PC ground plane.

Further preferably, forming the lugs includes forming the lugs to be substantially orthogonal to a plane of the plate, and connecting the lugs to the PC ground plane includes connecting a printed circuit which implements the PC transmission line to be substantially orthogonal to the coaxial ground plane.

Preferably, the lugs inlcude two lugs which are disposed symmetrically about the opening.

Further preferably, forming the lugs includes bending fingers forming the opening of the conductive plate substantially orthogonal thereto.

The method preferably also includes:

providing a stress-relief contact including a hollow cylinder coupled to a connecting tab, a wall of the hollow cylinder being split parallel to an axis of the cylinder; and aligning the stress-relief contact so that the hollow cylinder slidingly mates with the conductive pin and the connecting tab contacts the conductive strip.

Preferably, the opening is formed within the conductive plate.

Preferably, the conductive plate includes lugs, the lugs being adapted to be connected to the PC ground plane.

Preferably, the lugs are substantially orthogonal to a plane of the transition piece, and a printed circuit implementing the PC transmission line is substantially orthogonal to the coaxial ground plane.

Preferably, the lugs include two lugs which are disposed symmetrically about the opening.

Preferably, the lugs are formed by bending fingers forming the opening of the conductive plate substantially orthogonal thereto.

Preferably, the coaxial ground plane is implemented so as to protrude in a region close to the conductive pin.

Preferably, providing the conductive plate includes forming a protrusion from a plane including the plate in a region of the plate close to the opening.

Preferably, the conductive plate includes one or more further openings through which respective one or more screws penetrate so as to mate the plate with the coaxial ground plane.

Further preferably, the one or more further openings include respective one or more truncated conical holes, and the screws include respective flathead screws which seat in the respective truncated conical holes.

Preferably, the respective flathead screws seat in the respective truncated conical holes to form a substantially flat surface with the conductive plate.

Preferably, a printed circuit which implements the PC transmission line includes a non-indented straight edge which mates with the flat surface.

Preferably, the opening is formed as a generally rectangular indentation in an edge of the conductive plate, and as a semicircular arc having a diameter of the arc aligned with, and symmetrically disposed with respect to, a side of the indentation parallel to the edge.

Preferably, the opening includes a substantially circular hole within the conductive plate.

Preferably, the conductive plate includes a substantially flat surface which mates with a substantially straight edge of the PC transmission line, the surface and the PC ground plane being adapted to receive coupling material which electrically connects the surface and the PC ground plane, and which fixedly maintains the PC transmission line relative to the surface.

Preferably, the conductive plate includes at least one lug, the PC transmission line includes an upper and a lower side, the PC ground plane is formed on at least one of the upper and lower sides, the conductive strip is formed on the at least one of the upper and lower sides, the at least one lug is adapted to connect to the PC ground plane formed on the at least one of the upper and lower sides, and the conductive pin is adapted to connect to the conductive strip formed on the at least one of the upper and lower sides.

There is further provided, according to a preferred embodiment of the present invention, a transition piece for coupling a plurality of coaxial transmission lines, which terminate in respective conductive pins projecting through a conductive coaxial ground plane, to a plurality of printed circuit (PC) transmission lines, the transition piece including:

a conductive plate, which is adapted to be fixed between the coaxial ground plane and a PC ground plane of the plurality of PC transmission lines, so that the plate is in electrical contact with both the coaxial and PC ground planes while the respective conductive pins contact a respective plurality of conductive strips of the plurality of PC transmission lines, the plate having a plurality of openings each of which is shaped and aligned with the respective conductive pins so that a transition-impedance of each opening is substantially equal to a line impedance of the respective coaxial and PC transmission lines. The present invention will be more fully understood from the following detailed description of the preferred embodiments thereof, taken together with the drawings, in which:

DETAILED DESCRIPTION OF PREFERRED EMBODIMENTS

Figure 1A:
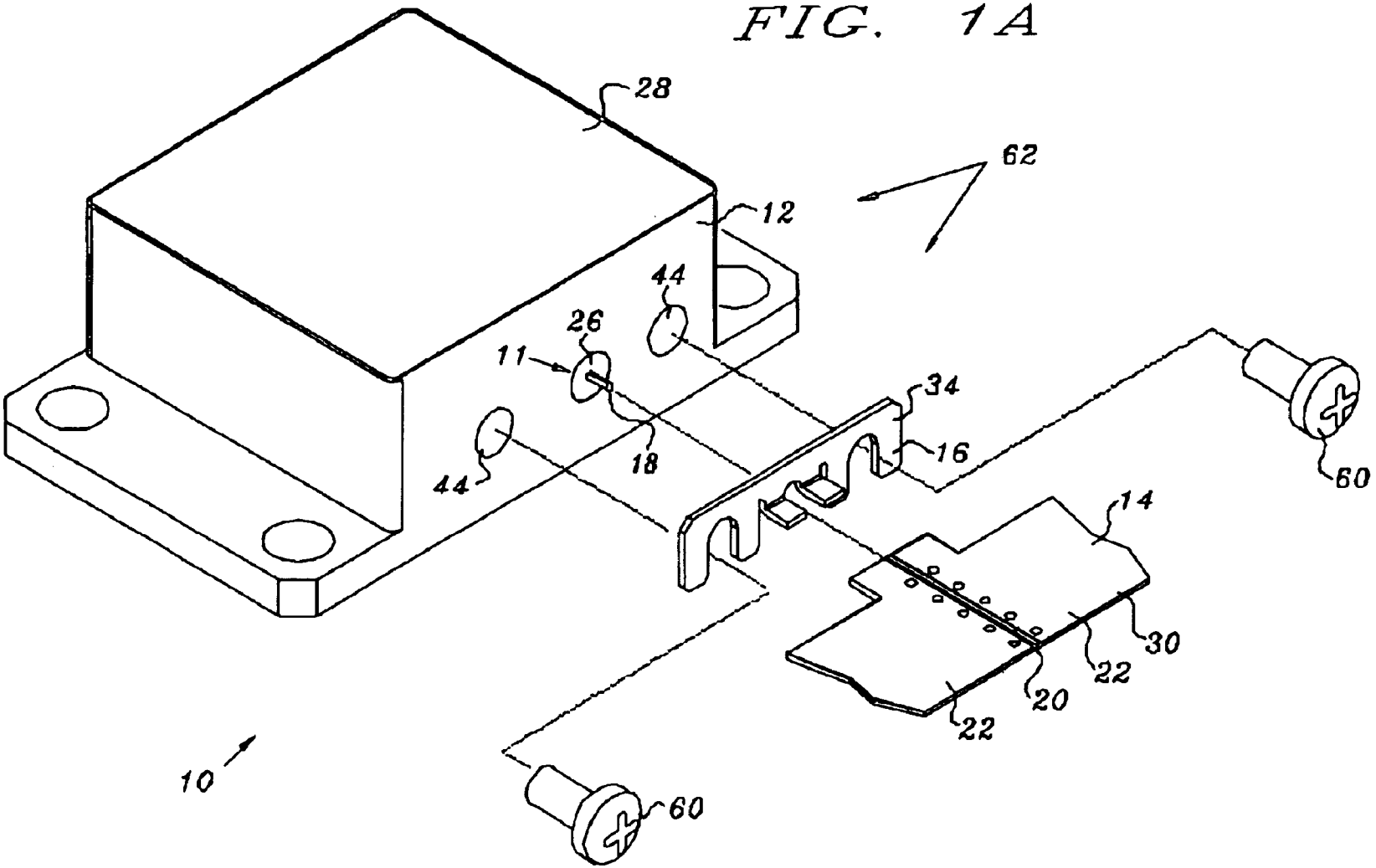
FIG. 1A is a schematic exploded diagram of transmission lines coupled in series, according to a preferred embodiment of the present invention.
Figure 1B:
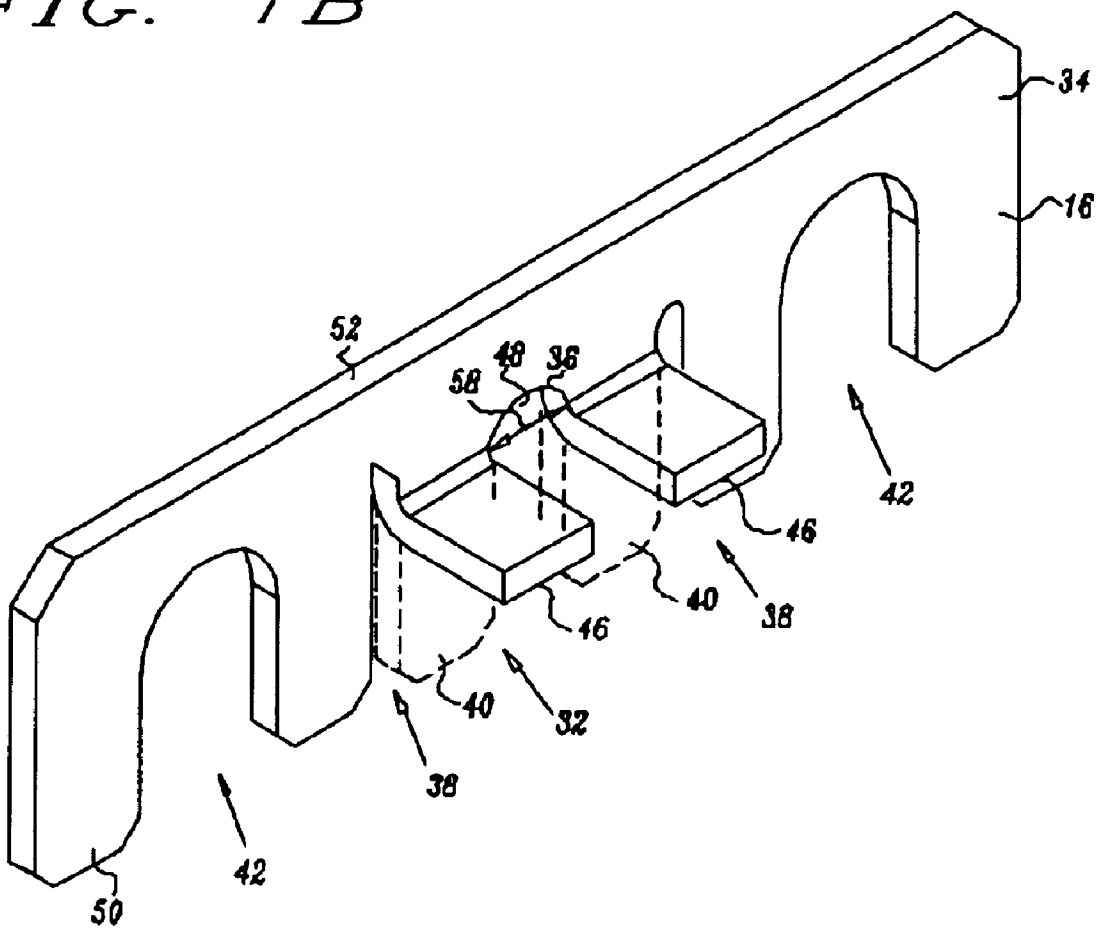
FIG. 1B is a schematic isometric diagram of a transition piece between the lines of FIG. 1A, according to a preferred embodiment of the present invention.

Reference is now made to FIG. 1A, which is a schematic exploded diagram of transmission lines 10 coupled in series, and to FIG. 1B, which is a schematic isometric diagram of a transition piece 16 between the lines, according to a preferred embodiment of the present invention. A coaxial transmission line terminates in an output 11 that consists of a conductive pin 18 which is centered on an opening 26 in a ground plane 12. Pin 18 protrudes substantially orthogonally from plane 12. Ground plane 12 is substantially flat, typically comprising an outer surface of a component 28 which is populated within the component by circuitry. It will be appreciated, however, that ground plane 12 may be formed from any other conductive plane. Preferably, the surface of ground plane 12 is plated with an inert good conductor such as gold. Component 28 and the circuitry within the component are implemented to operate at frequencies from 0 Hz (DC) to at least 50 GHz.

A diameter d of pin 18, and a diameter D of opening 26, are implemented so that an impedance of the output is a predetermined value such as 50 Ω. In some preferred embodiments of the present invention, opening 26 is partially or completely filled by a dielectric material having an effective dielectric constant $\epsilon$. The impedance Z of the output is given by:

$$Z = \frac{138}{\sqrt{\varepsilon}} \ln \frac{D}{d} \tag{1}$$

Ground plane 12 also comprises tapped holes 44, which are used to couple transition piece 16 to the plane, as described hereinbelow.

Transition piece 16 is most preferably formed from a single sheet 34 of conducting material, and is generally rectangular in outline. For clarity in the following explanation, sheet 34 is assumed to be oriented with a wider side of the rectangle horizontal. It will be appreciated, however, that transition piece 16 may operate in substantially any orientation.

An "arch-like" cutout 32 is formed generally centrally and symmetrically in a lower edge 50 of sheet 34, the cutout forming an arcuate opening having substantially vertical sides terminated in a semicircular arc 36. The separation of the vertical sides is substantially equal to a diameter 58 of arc 36, so that the sides are generally tangential to the arc. Two cutouts 38 are formed substantially symmetrically on either side of cutout 32 in edge 50, so as to form fingers 40 in sheet 34. Fingers 40 are bent to form lugs 46 that are substantially orthogonal to sheet 34, leaving a semicircular opening 48 in a foreshortened edge of the sheet. As described further below, lugs 46 are generally aligned with a center of arc 36. Cutouts 42 are also formed substantially symmetrically on either side of cutout 32, at positions in sheet 34 so that positions of cutouts 42 are generally in line with holes 44 of ground plane 12. Most preferably, transition piece 16 is coupled to component 28 by screwing screws 60 into holes 44, so that pin 18 aligns with the center of arc 36, to form a "drop-in" component 62 comprising component 28 and the transition. Alternatively, transition piece 16 is coupled to component 28 by a welding process known in the art, such as spot welding.

In some preferred embodiments of the present invention, a region of transition piece 16 close to cutout 32 is implemented to slightly protrude towards component 28. Thus, when the transition and the component are attached a better galvanic contact between them forms in a region close to cutout 32 than if the transition does not protrude. The protrusion may be implemented by any method known in the art, such as preferential etching of a region of transition piece 16. Alternatively or additionally, ground plane 12 is implemented to slightly protrude in a region close to opening 26, so as to improve the galvanic contact when the transition and the component are attached.

PC transmission line 14 comprises a linear conductive strip 20 which has a generally constant cross-section along its length and which is formed on a surface of a printed circuit board 30. Preferably, strip 20 is centrally and symmetrically disposed with respect to a pair of ground planes 22, the ground planes being physically separated from the strip and being formed on the same surface of board 30. Alternatively, PC line 14 is implemented from linear conductive strip 20 and one or more ground planes 22 physically separated from the strip, by methods which are well known in the transmission line art. For example, ground planes 22 may comprise conductive planes on surfaces other than the surface of strip 20, and may also comprise plated vias between some of the planes. Dimensions of strip 20 and of separations between the strip and ground planes 22 are implemented so that an impedance of the PC transmission line is substantially equal to the impedance of output 11.

Drop-in component 62 is aligned with transmission line 14 by butting an edge of PC board 30 with a surface 52 of transition piece 16, by butting lugs 46 to a horizontally-oriented surface of ground planes 22, and so that an end of strip 20 contacts pin 18 and is substantially centered at a base of opening 48. Lugs 46 are formed so that a horizontal level of the lugs with respect to the center of arc 36 is set so that the above alignment occurs. It will be appreciated that one or more of lugs 46 may be at different horizontal levels, depending on how ground planes 22 are implemented. Lugs 46 are then mechanically and electrically coupled to ground planes 22, and pin 18 is similarly coupled to strip 20. In some preferred embodiments of the present invention, solder preforms are inserted between lugs 46 and planes 22, and/or between pin 18 and strip 20, and a process of parallel gap welding is used to heat the preforms so that they weld their respective contacting entities. Other methods for coupling lugs 46 to ground planes 22, and pin 18 to strip 20, will be familiar to those skilled in the art. Most preferably, lugs 46 maintain board 30 substantially orthogonal to surface 52 of the transition.

Diameter 58 of arc 36 is most preferably implemented so that an impedance of transition piece 16, when the transition is positioned to couple output 11 and PC transmission line 14 as described above, is substantially equal to the impedances of the output and of the line. Equation (1) may be used to estimate a first approximation for diameter 58, using the diameter of pin 18 as the value of d.

Figure 2:
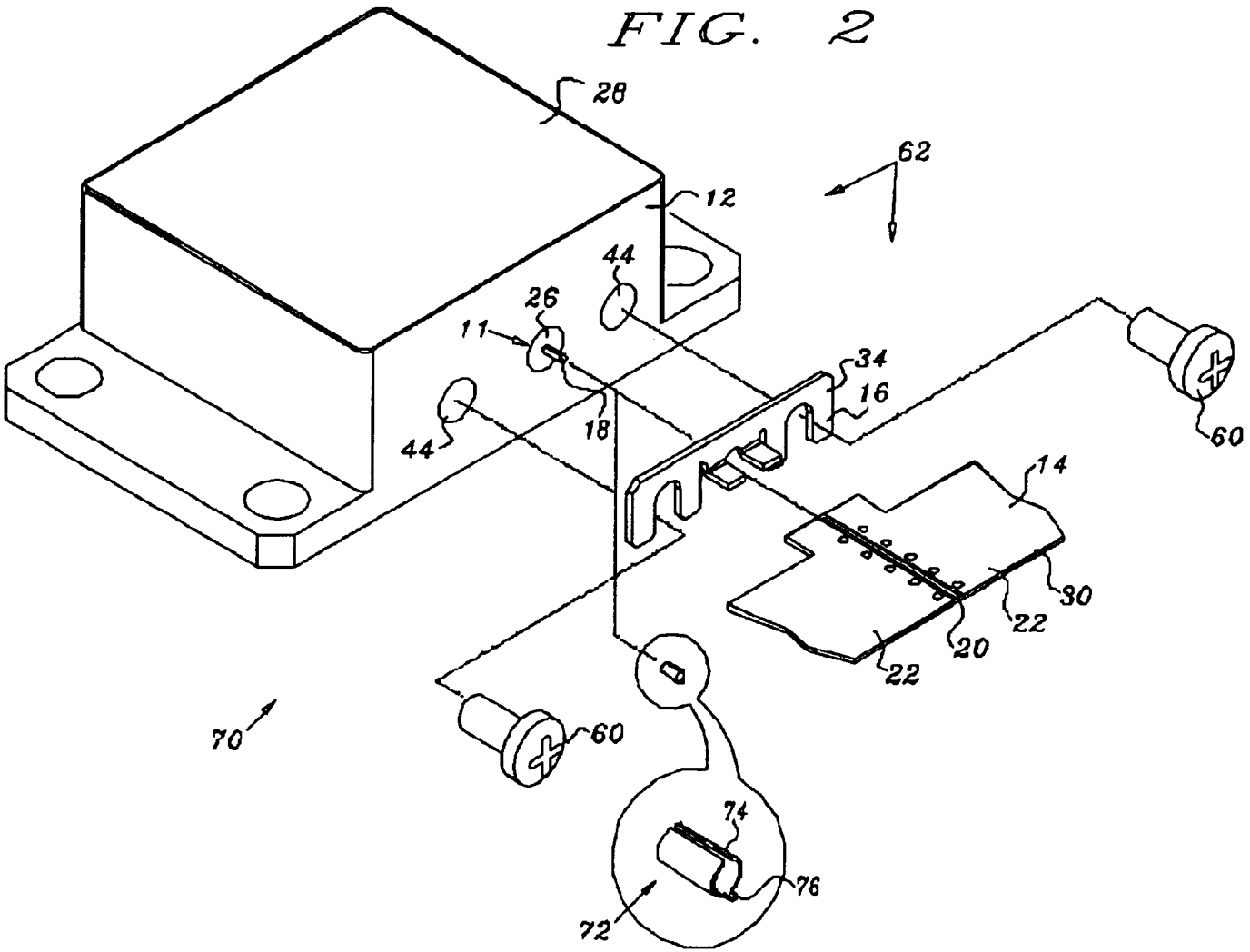
FIG. 2 is a schematic exploded diagram of transmission lines coupled in series, according to an alternative preferred embodiment of the present invention.

FIG. 2 is a schematic exploded diagram of coupled transmission lines 70, according to an alternative preferred embodiment of the present invention. Apart from the differences described below, the operation of lines 70 is generally similar to that of lines 10 (FIGS. 1A and 1B), so that elements indicated by the same reference numerals in coupled lines 70 and 10 are generally identical in construction and in operation. Before PC line 14 is coupled to drop-in component 62, a stress-relief contact 72 is attached to pin 18. Preferably, contact 72 is substantially similar to a stress-relief contact K110-1 or V110-1 produced by Anritsu Corporation of Richardson, Tex. Contact 72 comprises a hollow cylinder 74 having a tab 76 protruding from an end of the cylinder. The wall of cylinder 74 is split parallel to the axis of the cylinder. The cylinder is formed to have an internal diameter of a dimension allowing it to be slidingly mated with pin 18, effectively increasing the diameter of the pin to be the external diameter of cylinder 74. Most preferably, diameter 58 of arc 36 is implemented to take account of the effective increased diameter of pin 18.

After contact 72 has been slid onto pin 18, tab 76 is soldered/welded to strip 20, and lugs 46 are soldered/welded to ground planes 22, substantially as described above for lines 10.

Figure 3:
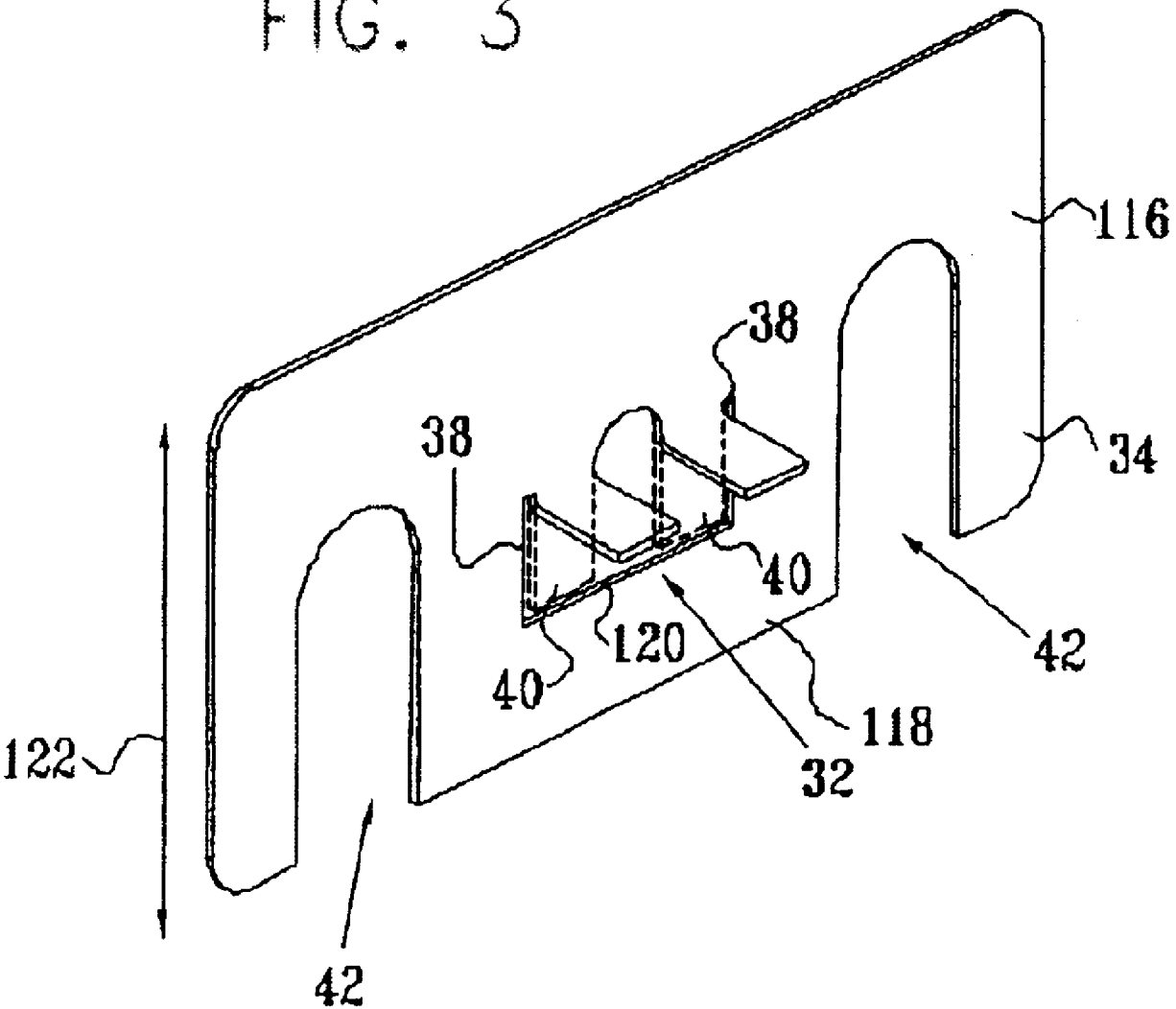
FIG. 3 is a schematic isometric diagram of an alternative transition piece, according to a preferred embodiment of the present invention.

FIG. 3 is a schematic isometric diagram of an alternative transition piece 116, according to a preferred embodiment of the present invention. Apart from the differences described below, implementation and operation of transition piece 116 is generally similar to that of transition piece 16 (FIG. 1B), so that elements indicated by the same reference numerals in transition pieces 16 and 116 are generally similar in construction and in operation. In contrast to transition piece 16, arch-like cutout 32 of transition piece 116 is formed as an arcuate opening within single sheet 34, so that the cutout is bounded on its lower edge by a section 118 of piece 116. Fingers 40, on either side of cutout 32, are formed by cutouts 38 and an upper edge 120 of part 118, and the fingers are bent to form lugs 46. It will be appreciated that, due to section 118, a vertical height 122 of transition piece 116 is greater than a vertical height of transition piece 16, and that cutouts 42 for transition piece 116 are correspondingly deeper than those of transition piece 16.

Figure 4A:
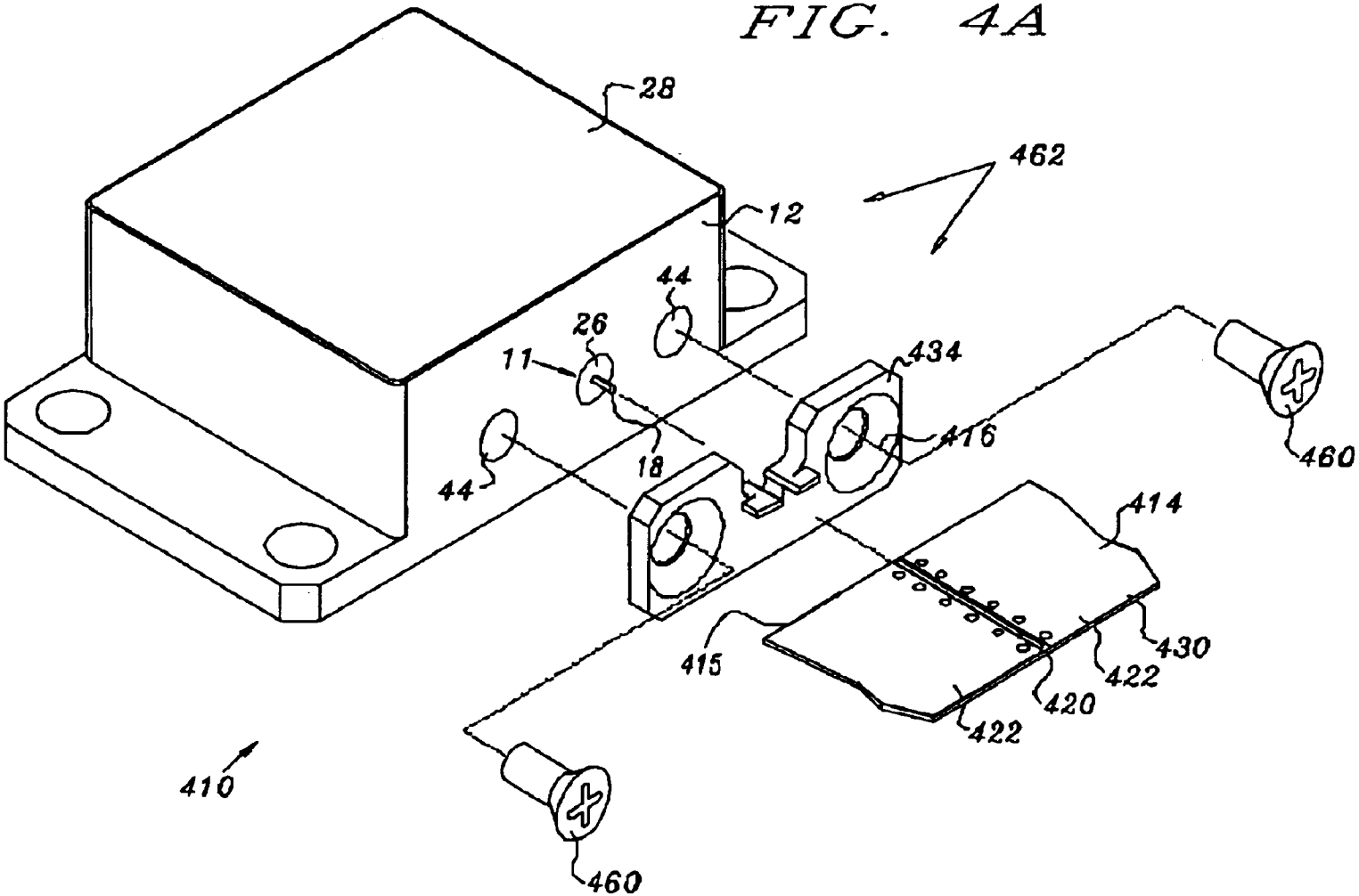
FIG. 4A is a schematic exploded diagram of transmission lines coupled in series, according to an alternative preferred embodiment of the present invention.
Figure 4B:
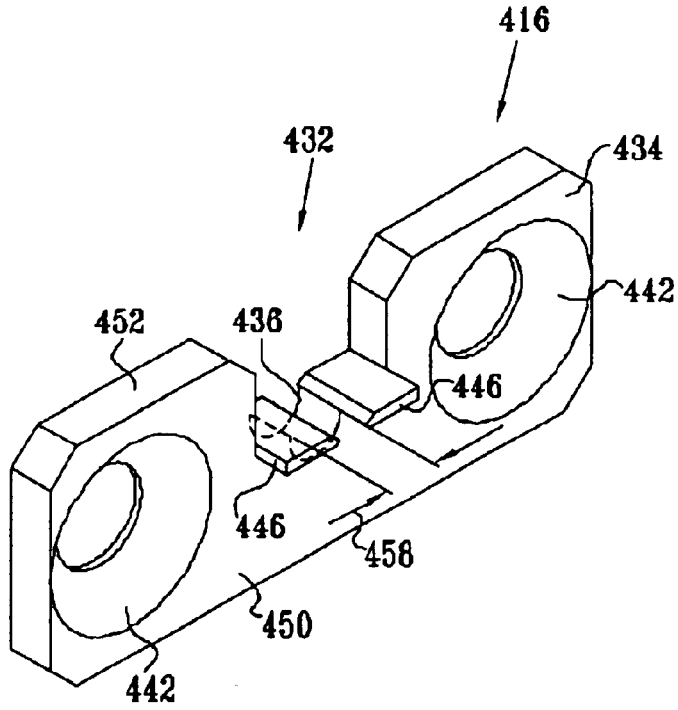
FIG. 4B is a schematic isometric diagram of a further alternative transition piece between the lines of FIG. 4A, according to a preferred embodiment of the present invention.

Reference is now made to FIG. 4A, which is a schematic exploded diagram of transmission lines 410 coupled in series, and to FIG. 4B, which is a schematic isometric diagram of a transition piece 416 between the lines, according to an alternative preferred embodiment of the present invention. Apart from the differences described below, implementation and operation of transition piece 416 is generally similar to that of transition pieces 16 and 116 (FIG. 1A, FIG. 1B, FIG. 2 and FIG. 3), so that elements indicated by the same reference numerals in transition pieces 16, 116, and 416 are generally similar in construction and in operation. Transition piece 416 is most preferably formed from a single sheet 434 of conducting material, and is generally rectangular in outline. Most preferably, piece 416 is formed by milling or chemically etching the single sheet. For clarity in the following explanation, sheet 434 is assumed to be oriented with a wider side of the rectangle horizontal. It will be appreciated, however, that transition piece 416 may operate in substantially any orientation.

A generally rectangular indentation 432 is formed generally centrally and symmetrically in an upper edge 452 of sheet 434, the indentation forming an opening having substantially vertical sides and terminating with a horizontal side substantially at the center of sheet 434. Preferably, corners that indentation 432 makes with edge 452 are chamfered. A semicircular arc 436 is formed with the diameter of the arc aligned to be substantially collinear with the horizontal side of the indentation and substantially centered between the vertical sides of the indentation. Two contacting lugs 446 are joined to the horizontal side of the indentation on either side of semicircular arc 436, the lugs protruding substantially orthogonally from one side of sheet 434. Contacting lugs 446 are formed, so that they contact ground planes 422 of a PC transmission line 414, as described further below. As also described further below, lugs 446 are generally aligned with a center of arc 436. Preferably, if transition piece 416 is formed by milling or chemically etching single sheet 434, lugs 446 are formed during the process. Alternatively, lugs 446 comprise generally rectangular conductive elements separate from sheet 434, which are connected to the sheet to form transition piece 416.

Further alternatively, transition piece 416 is initially implemented without lugs 446, and the lugs are implemented in the form of connecting tabs, preferably formed from conductive ribbon such as gold ribbon. The tabs are welded to ground planes 422 and to transition piece 416 when PC transmission line 414 is connected to the transition piece. Thus the tabs act as coupling material which electrically couples transition piece 416 and ground planes 422, and which maintains the transition piece and the PC transmission line in substantially fixed orientation with respect to each other.

Two truncated conical holes 442 are also formed substantially symmetrically on either side of indentation 432, at positions in sheet 434 so that centers of the respective conical holes are generally in line with holes 44 of ground plane 12. Most preferably, transition piece 416 is coupled to component 28 by screwing flathead screws 460, also known as conical head screws, through conical holes 442 into holes 44, so that pin 18 aligns with the center of arc 436, to form a drop-in component 462 comprising component 28 and the transition piece. Flathead screws 460, when fastened completely to component 28, seat their conical heads into conical holes 442, so that a surface 450 of sheet 434 with the screw heads is substantially flat. The substantially flat surface provides a larger surface for mating the transition piece to PC transmission line 414, as described further below. Alternatively, transition piece 416 is coupled to component 28 by a another process known in the art, such as soldering, spot welding or use of conductive glue.

In some preferred embodiments of the present invention, a region of transition piece 416 close to indentation 432 is implemented to slightly protrude towards component 28. Thus, when the transition and the component are attached a better galvanic contact between them forms in a region close to indentation 432 than if the transition piece does not protrude. The protrusion may be implemented by any method known in the art, such as preferential etching of a region of transition piece 416. Alternatively or additionally, ground plane 12 is implemented to slightly protrude in a region close to opening 26, so as to improve the galvanic contact when the transition piece and the component are attached.

Except as described below, PC transmission line 414 is generally similar to PC transmission line 14, described above with reference to FIG. 1A, so that a linear conductive strip 420 and ground planes 422 are respectively substantially similar in construction and operation to strip 20 and ground planes 22. Unlike transmission line 14 which has a protruding edge, PC transmission line 414 comprises a substantially non-indented straight edge 415, which is able to mate with substantially flat surface 450.

Drop-in component 462 is aligned with transmission line 414 by butting edge 415 of PC board 430 with surface 450 of transition piece 416, by butting lugs 446 to a horizontally-oriented surface of ground planes 422, and so that an end of strip 420 contacts pin 18 and is substantially centered at a base of arc 436. Lugs 446 are formed so that a horizontal level of the lugs with respect to the center of arc 436 is set so that the above alignment occurs. It will be appreciated that one or more of lugs 446 may be at different horizontal levels, depending on how ground planes 422 are implemented. Lugs 446 are then mechanically and electrically coupled to ground planes 422, and pin 18 is similarly coupled to strip 420. In some preferred embodiments of the present invention, solder preforms are inserted between lugs 446 and planes 422, and/or between pin 18 and strip 420, and a process of parallel gap welding is used to heat the preforms so that they weld their respective contacting entities. Other methods for coupling lugs 446 to ground planes 422, and pin 18 to strip 420, will be familiar to those skilled in the art. Most preferably, lugs 446 maintain board 430 substantially orthogonal to the transition piece.

Diameter 458 of arc 436 is most preferably implemented so that an impedance of transition 416, when the transition is positioned to couple output 11 and PC transmission line 414 as described above, is substantially equal to the impedances of the output and of the line. Equation (1) may be used to estimate a first approximation for diameter 458, using the diameter of pin 18 as the value of d.

Figure 5:
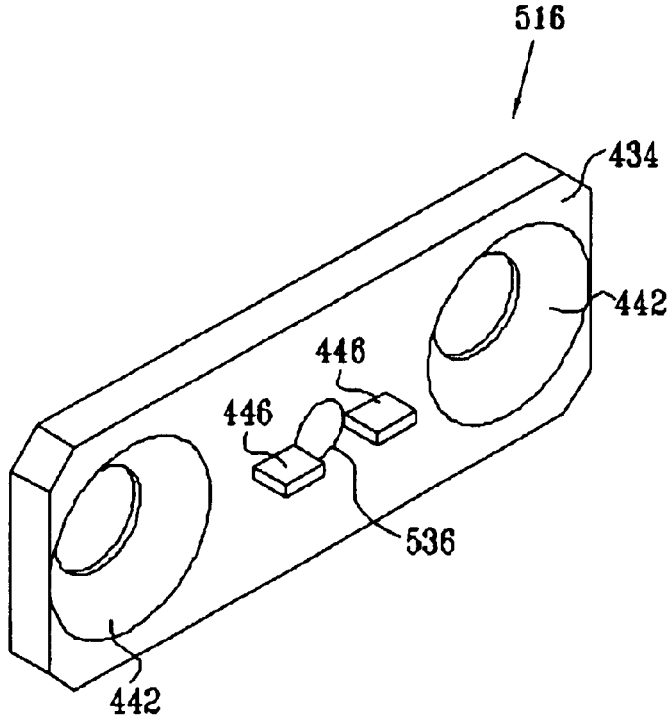
FIG. 5 is a schematic isometric diagram of an alternative transition piece between the lines of FIG. 4A, according to a preferred embodiment of the present invention.

FIG. 5 is a schematic isometric diagram of an alternative transition piece 516, according to a preferred embodiment of the present invention. Apart from the differences described below, implementation and operation of transition piece 516 is generally similar to that of transition piece 416 (FIG. 4B), so that elements indicated by the same reference numerals in transition pieces 516 and 416 are generally similar in construction and in operation. In contrast to transition piece 416, transition piece 516 is formed with a substantially circular hole 536 in single sheet 434, substantially centered in both vertical and horizontal directions of the sheet. Hole 536 replaces indentation 432 and semicircular arc 436. Lugs 446 are formed on either side of circular hole 536.

As previously noted with drop-in component 62 in FIG. 2, a stress-relief contact 72 may be similarly used with drop-in component 462 (FIG. 4A), which comprises either transition piece 416 or 516 (FIG. 4B or 5, respectively).

It will be understood that while the preferred embodiments described above comprise a transition piece which couples one coaxial transmission line to one PC transmission line, the scope of the present invention comprises coupling a plurality of coaxial transmission lines with a respective plurality of PC transmission lines. For example, a transition piece generally similar to transition pieces 416 or 516, but having two openings, may be used to couple a differential coaxial transmission line, comprising two coaxial transmission lines, with a differential PC transmission line, comprising two PC transmission lines.

PC transmission lines such as line 14 and line 414 may be configured with ground planes 22 and 422 on either an upper or a lower side, or on both sides, of the printed circuit board from which they are formed. When implemented on both sides, the two sides are preferably connected by conducting vias. Similarly, central strip 20 or 420 of the PC transmission line may be configured on an upper or a lower side, or on both sides, of the printed circuit board. It will be appreciated that coaxial pin 18, or tab 76 when stress relief 72 is used, may be connected to the upper side or the lower side of the PC board according to how central strip 20 or 420 is configured.

Independently of how pin 18 or tab 76 is connected to the central strip, each lug of transitions 16, 116, 416, and 516 may be connected to ground planes 22 or 422 regardless of whether the ground planes are formed on an upper side, a lower side, or both sides, of the printed circuit board forming the PC transmission line.

Figure 6:
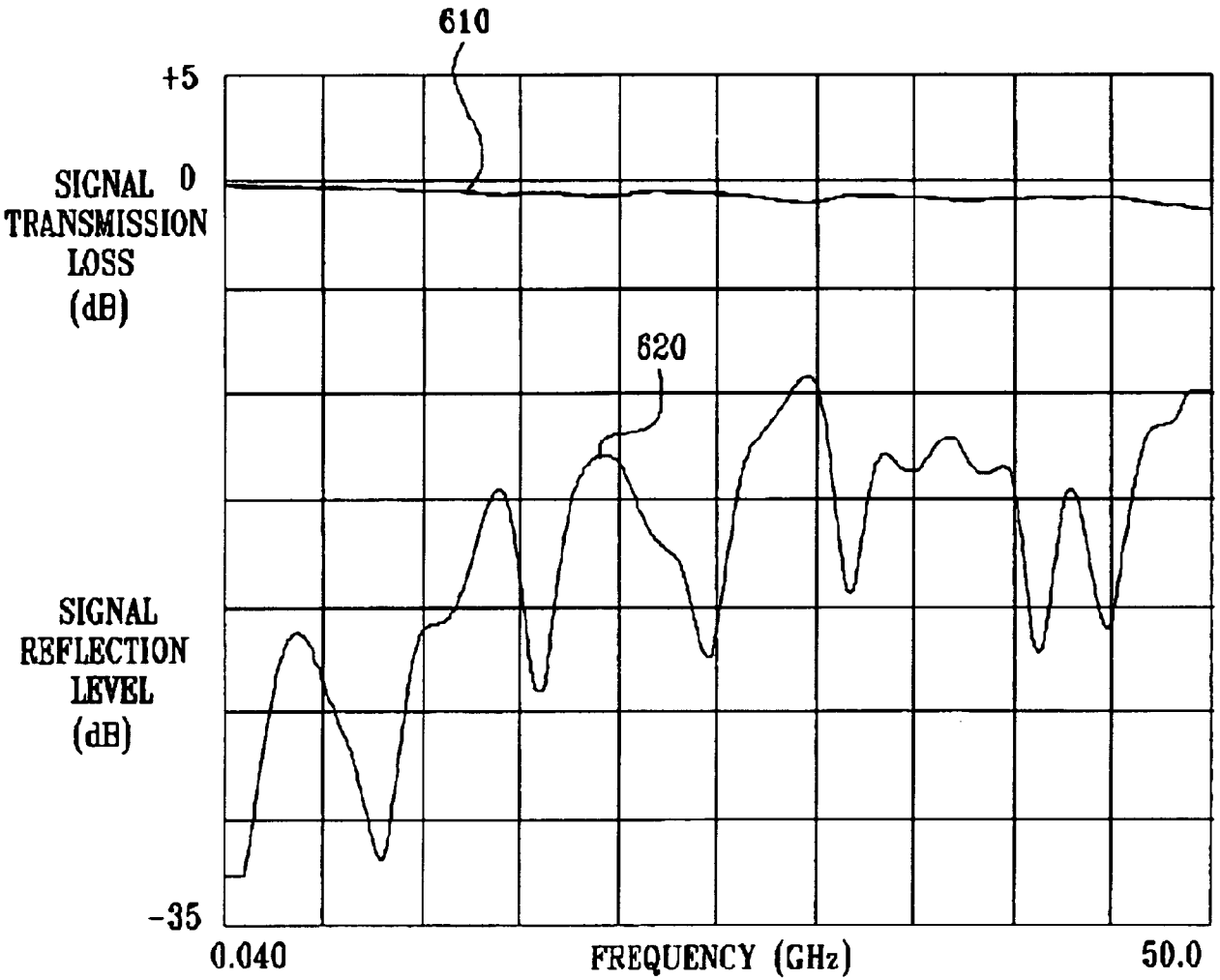
FIG. 6 is a graph of signal transmission loss and signal reflection level vs. frequency for the transition piece of FIG. 1B, according to a preferred embodiment of the present invention.

Reference is now made to FIG. 6, which is a graph of signal transmission loss and signal reflection level vs. frequency for transition 16 (FIG. 1A), according to a preferred embodiment of the present invention. Transitions 116, 416, and 516 exhibit generally similar characteristics to those of transition 16. To generate the graph an experimental apparatus was fabricated having component 28 coupled to transition piece 16, which in turn, was coupled to PC transmission line 14, as previously described and shown in FIG. 1A. A second end of PC transmission line 14 was then coupled to an additional transition piece 16, which was in turn connected to an additional component 28 The experimental apparatus thus comprised two drop-in components 28 coupled in a "back-to-back" arrangement by line 14. Radio-frequency signals ranging from 0.04 to 50.0 GHz were generated in the first component and a transmitted signal was measured in the additional component. The difference between the generated signal in the first component and the signal measured in the additional component was calculated as the signal transmission loss. Signals reflected back to the first component were also measured. The difference between the generated signal and the measured reflected signal was calculated as the signal reflection level.

Results from the experimental apparatus described above are plotted in the graph of FIG. 6, where a vertical axis of the graph ranges from 5 to −35 decibels. Signal transmission loss is shown by a graph 610. The signal transmission loss for the entire 0.04 to 50.0 GHz range is virtually constant, and at 40 GHz has a value of approximately 0.8 dB. It will be appreciated that since the measured transmission loss includes losses due to the two coaxial connectors and the PC transmission line, a loss of a single transition 16 is of the order of 0.1 dB. Reflected signal is shown by a graph 620. Inspection of graph 620 shows that return loss is better than 10 dB over virtually the whole range of measured frequencies.

It will be appreciated that the preferred embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

What is claimed is:

1. A transition piece for coupling a coaxial transmission line, which terminates in a conductive pin projecting through a conductive coaxial ground plane, to a printed circuit (PC) transmission line, the transition piece comprising:

a conductive plate, which is adapted to be fixed between the coaxial ground plane and a PC ground plane of the PC transmission line so that the plate is in electrical contact with both the coaxial and PC ground planes while the conductive pin contacts a conductive strip of the PC transmission line, the plate having a first opening which is shaped and aligned with the pin so that a transition-impedance of the transition piece is substantially equal to a line impedance of the coaxial and PC transmission lines and one or more second openings in an outer edge of the plate for adjustably aligning and coupling the plate to the coaxial ground plane.

2. A transition piece according to claim 1, wherein the first opening is formed in the outer edge of the conductive plate.

3. A transition piece according to claim 2, wherein the conductive plate comprises lugs, the lugs being adapted to be connected to the PC ground plane.

4. A transition piece according to claim 3, wherein the lugs are substantially orthogonal to a plane of the transition piece.

5. A transition piece according to claim 3, wherein the lugs comprise two lugs which are disposed symmetrically about the first opening.

6. A transition piece according to claim 1, wherein the first opening comprises a substantially circular hole within the conductive plate.

7. A transition piece according to claim 1, and comprising a stress-relief contact comprising a hollow cylinder coupled to a connecting tab, a wall of the hollow cylinder being split parallel to an axis of the cylinder, the stress-relief contact being aligned so that the hollow cylinder slidingly mates with the conductive pin and the connecting tab contacts the conductive strip.

8. A transition piece according to claim 1, wherein the first opening is formed within the conductive plate.

9. A transition piece according to claim 8, wherein the conductive plate comprises lugs, the lugs being adapted to be connected to the PC ground plane.

10. A transition piece according to claim 9, wherein the lugs are substantially orthogonal to a plane of the transition piece.

11. A transition piece according to claim 9, wherein the lugs comprise two lugs which are disposed symmetrically about the first opening.

12. A transition piece according to claim 1, wherein the conductive plate comprises a substantially flat surface which mates with a substantially straight edge of the PC transmission line, the surface and the PC ground plane being adapted to receive coupling material which electrically connects the surface and the PC ground plane, and which fixedly maintains the PC transmission line relative to the surface.

13. A transition piece according to claim 1, wherein the coaxial ground plane is implemented so as to protrude in a region close to the conductive pin.

14. A transition piece according to claim 1, wherein the conductive plate is implemented so as to protrude from a plane comprising the plate in a region close to the first opening.

15. A transition piece according to claim 1, wherein the one or more second openings are penetrated by respective one or more screws so as to mate the plate with the coaxial ground plane.

16. A transition piece according to claim 1, wherein the conductive plate comprises at least one lug, wherein the PC transmission line comprises an upper and a lower side, wherein the PC ground plane is formed on at least one of the upper and lower sides, wherein the conductive strip is formed on the at least one of the upper and lower sides, wherein the at least one lug is adapted to connect to the PC ground plane formed on the at least one of the upper and lower sides, and wherein the conductive pin is adapted to connect to the conductive strip formed on the at least one of the upper and lower sides.

17. A method for coupling a coaxial transmission line, which terminates in a conductive pin projecting through a conductive coaxial ground plane, to a printed circuit (PC) transmission line, the method comprising:

providing a conductive plate;

removing material from the plate so as to form an opening in the plate; and connecting the plate between the coaxial ground plane and a PC ground plane of the PC transmission line so that the plate is in electrical contact with both the coaxial and PC around planes while the conductive pin contacts a conductive strip of the PC transmission line and aligns with the opening so that a transition-impedance of the plate is substantially equal to a line impedance of the coaxial and PC transmission lines, wherein the opening is formed in an edge of the conductive plate, wherein removing the material comprises forming an indentation in the edge, and wherein connecting the plate comprises forming lugs therein and connecting the lugs to the PC ground plane.

18. A method according to claim 17, wherein forming the lugs comprises forming the lugs to be substantially orthogonal to a plane of the plate, and wherein connecting the lugs to the PC ground plane comprises connecting a printed circuit which implements the PC transmission line to be substantially orthogonal to the coaxial ground plane.

19. A method according to claim 17, wherein the lugs comprise two lugs which are disposed symmetrically about the opening.

20. A method according to claim 17, wherein forming the lugs comprises bending fingers forming the opening of the conductive plate substantially orthogonal thereto.

21. A transition piece for coupling a coaxial transmission line, which terminates in a conductive pin projecting through a conductive coaxial around plane, to a printed circuit (PC) transmission line, the transition piece comprising:

a conductive plate, which is adapted to be fixed between the coaxial ground plane and a PC around plane of the PC transmission line so that the plate is in electrical contact with both the coaxial and PC around planes while the conductive pin contacts a conductive strip of the PC transmission line, the plate having an opening which is shaped and aligned with the pin so that a transition-impedance of the transition piece is substantially equal to a line impedance of the coaxial and PC transmission lines, wherein the opening is formed in an edge of the conductive plate, wherein the conductive plate comprises lugs, the lugs being adapted to be connected to the PC ground plane, and wherein the lugs are formed by bending fingers forming the opening of the conductive plate substantially orthogonal thereto.

22. A transition piece for coupling a coaxial transmission line, which terminates in a conductive pin projecting through a conductive coaxial ground plane, to a printed circuit (PC) transmission line, the transition piece comprising:

a conductive plate, which is adapted to be fixed between the coaxial ground plane and a PC around plane of the PC transmission line so that the plate is in electrical contact with both the coaxial and PC around planes while the conductive pin contacts a conductive strip of the PC transmission line, the plate having an opening which is shaped and, aligned with the pin so that a transition-impedance of the transition piece is substantially equal to a line impedance of the coaxial and PC transmission lines, wherein the opening is formed within the conductive plate, wherein the conductive plate comprises lugs, the lugs being adapted to be connected to the PC ground plane, wherein the lugs are formed by bending fingers forming the opening of the conductive plate substantially orthogonal thereto.

23. A method for coupling a coaxial transmission line, which terminates in a conductive pin projecting through a conductive coaxial ground plane, to a printed circuit (PC) transmission line, the method comprising:

providing a conductive plate;

removing material from the plate so as to form a first opening in the plate and one or more second openings in an outer edge of the plate;

adjustably aligning and coupling the plate to the coaxial ground plane via the one or more second openings so that the plate is in electrical contact with the coaxial ground planes and connecting the plate to a PC ground plane of the PC transmission line so that the plate is in electrical contact with the PC ground plane while the conductive pin contacts a conductive strip of the PC transmission line and aligns with the first opening so that a transition-impedance of the plate is substantially equal to a line impedance of the coaxial and PC transmission lines.

24. A method according to claim 23, wherein the first opening is formed in the outer edge of the conductive plate.

25. A method according to claim 23, wherein providing the conductive plate comprises forming a protrusion from a plane comprising the plate in a region of the plate close to the first opening.

26. A method according to claim 23, wherein couplings the conductive plate comprises penetrating the one or more second openings with respective one or more screws so as to mate the plate with the coaxial ground plane.

27. A method according to claim 23, wherein the first opening comprises a substantially circular hole within the conductive plate.

28. A method according to claim 23, wherein the conductive plate comprises a substantially flat surface which mates with a substantially straight edge of the PC transmission line, the surface and the PC ground plane being adapted to receive coupling material which electrically connects the surface and the PC ground plane, and which fixedly maintains the PC transmission line relative to the surface.

29. A method according to claim 23, and comprising:

providing a stress-relief contact comprising a hollow cylinder coupled to a connecting tab, a wall of the hollow cylinder being split parallel to an axis of the cylinder; and aligning the stress-relief contact so that the hollow cylinder slidingly mates with the conductive pin and the connecting tab contacts the conductive strip.

30. A method according to claim 23, wherein the first opening is formed within the conductive plate.

31. A method according to claim 30, wherein the conductive plate comprises lugs, the lugs being adapted to be connected to the PC ground plane.

32. A method according to claim 31, wherein the lugs are substantially orthogonal to a plane of the transition piece, and wherein a printed circuit implementing the PC transmission line is substantially orthogonal to the coaxial ground plane.

33. A method according to claim 31, wherein the lugs comprise two lugs which are disposed symmetrically about the first opening.

34. A method according to claim 23, wherein the conductive plate comprises at least one lug, wherein the PC transmission line comprises an upper and a lower side, wherein the PC ground plane is formed on at least one of the upper and lower sides, wherein the conductive strip is formed on the at least one of the upper and lower sides, wherein the at least one lug is adapted to connect to the PC ground plane formed on the at least one of the upper and lower sides, and wherein the conductive pin is adapted to connect to the conductive strip formed on the at least one of the upper and lower sides.

35. A method according to claim 23, wherein the coaxial ground plane is implemented so as to protrude in a region close to the conductive pin.

36. A transition piece for coupling a coaxial transmission line, which terminates in a conductive pin projecting through a conductive coaxial ground plane, to a printed circuit (PC) transmission line, the transition piece comprising:

a conductive plate, which is adapted to be fixed between the coaxial ground plane and a PC ground plane of the PC transmission line so that the plate is in electrical contact with both the coaxial and PC ground planes while the conductive pin contacts a conductive strip of the PC transmission line, the plate having an opening which is shaped and aligned with the pin so that a transition-impedance of the transition piece is substantially equal to a line impedance of the coaxial and PC transmission lines, wherein the opening is formed as a generally rectangular indentation in an edge of the conductive plate, and as a semicircular arc having a diameter of the arc aligned with, and symmetrically disposed with respect to, a side of the indentation parallel to the edge.

37. A method for coupling a coaxial transmission line, which terminates in a conductive pin protecting through a conductive coaxial ground plane, to a printed circuit (PC) transmission line, the method comprising:

providing a conductive plate;

removing material from the plate so as to form an opening in the plate; and connecting the plate between the coaxial ground plane and a PC ground plane of the PC transmission line so that the plate is in electrical contact with both the coaxial and PC ground planes while the conductive pin contacts a conductive strip of the PC transmission line and aligns with the opening so that a transition-impedance of the plate is substantially equal to a line impedance of the coaxial and PC transmission lines, wherein the opening is formed within the conductive plate, wherein the conductive plate comprises lugs, the lugs being adapted to be connected to the PC ground plane, wherein the lugs are formed by bending fingers forming the opening of the conductive plate substantially orthogonal thereto.

38. A method for coupling a coaxial transmission line, which terminates in a conductive pin projecting through a conductive coaxial ground plane, to a printed circuit (PC) transmission line, the method comprising:

providing a conductive plate; removing material from the plate so as to form opening in the plate; and connecting the plate between the coaxial around plane and a PC around plane of the PC transmission line so that the plate is in electrical contact with both the coaxial and PC ground planes while the conductive pin contacts a conductive strip of the PC transmission line and aligns with the opening so that a transition-impedance of the plate is substantially equal to a line impedance of the coaxial and PC transmission lines, wherein the opening is formed as a generally rectangular indentation in an edge of the conductive plate, and as a semicircular arc having a diameter of the arc aligned with, and symmetrically disposed with respect to, a side of the indentation parallel to the edge.

39. A transition piece for coupling a plurality of coaxial transmission lines, which terminate in respective conductive pins projecting through a conductive coaxial ground plane, to a plurality of printed circuit (PC) transmission lines, the transition piece comprising:

a conductive plate, which is adapted to be fixed between the coaxial ground plane and a PC ground plane of the plurality of PC transmission lines, so that the plate is in electrical contact with both the coaxial and PC ground planes while the respective conductive pins contact a respective plurality of conductive strips of the plurality of PC transmission lines, the plate having a plurality of first openings each of which is shaped and aligned with the respective conductive pins so that a transition-impedance of each first opening is substantially equal to a line impedance of the respective coaxial and PC transmission lines and one or more second openings in an outer edge of the plate for adjustably aligning and coupling the plate to the coaxial around plane.

* * * * *